US011788553B2

(12) United States Patent
Li et al.

(10) Patent No.: US 11,788,553 B2
(45) Date of Patent: Oct. 17, 2023

(54) SELF-ROTATION GRAPHENE HEAT-DISSIPATION DEVICE FOR DIRECT-DRIVE ELECTRO-HYDROSTATIC ACTUATOR

(71) Applicant: Harbin Institute of Technology, Harbin (CN)

(72) Inventors: Songjing Li, Harbin (CN); Jinghui Peng, Harbin (CN); Yayun Zhang, Harbin (CN); Rui Yang, Harbin (CN)

(73) Assignee: Harbin Institute of Technology, Harbin (CN)

( * ) Notice: Subject to any disclaimer, the term of this patent is extended or adjusted under 35 U.S.C. 154(b) by 0 days.

(21) Appl. No.: 17/744,851

(22) Filed: May 16, 2022

(65) Prior Publication Data

US 2022/0381266 A1 Dec. 1, 2022

(30) Foreign Application Priority Data

May 31, 2021 (CN) ..... 202110599854.6

(51) Int. Cl.

| | |
|---|---|
| ***F04D 29/58*** | (2006.01) |
| ***F04C 15/00*** | (2006.01) |
| ***F01C 1/344*** | (2006.01) |
| ***F01C 21/06*** | (2006.01) |
| ***F04D 29/32*** | (2006.01) |
| *F15B 15/14* | (2006.01) |

(52) U.S. Cl.

CPC ..... *F04D 29/5806* (2013.01); *F01C 1/3442* (2013.01); *F01C 21/06* (2013.01); *F04C 15/0096* (2013.01); *F04D 29/325* (2013.01); *F04D 29/584* (2013.01); *F15B 15/1485* (2013.01)

(58) Field of Classification Search

CPC .... F01C 1/3442; F01C 21/06; F04C 15/0096; F04D 29/5806; H02K 5/20; H02K 5/207

See application file for complete search history.

(56) References Cited

U.S. PATENT DOCUMENTS

| | | | | |
|---|---|---|---|---|
| 3,664,129 A * | 5/1972 | Schwab | F01P 7/044 | 60/912 |
| 4,009,973 A * | 3/1977 | Heinrich | F01C 19/12 | 418/268 |
| 6,086,346 A * | 7/2000 | Mallen | F01C 21/04 | 418/91 |

(Continued)

*Primary Examiner* — Kenneth Bomberg
*Assistant Examiner* — Matthew Wiblin
(74) *Attorney, Agent, or Firm* — The Dobrusin Law Firm, P.C.

(57) ABSTRACT

A self-rotation graphene heat-dissipation device for a direct-drive electro-hydrostatic actuator, that includes inner and outer walls of a shell eccentrically arranged relative to each other, the shell sleeves on an outer side of a self-rotation mechanism. The self-rotation mechanism is arranged on an outer side of a shaft; the shaft is coaxial with the inner wall of the shell and connected with outer and inner end covers. The self-rotation mechanism includes a rotor and blades, the rotor sleeves on the shaft and is connected with the outer and inner end covers. The rotor is slidably connected with the blades, and outer walls of the blades are closely attached to the inner wall of the shell. Graphene heat-dissipation layers are coated on outer walls of all of the shell, blades, the rotor, the inner and outer end covers respectively.

8 Claims, 11 Drawing Sheets

(56) References Cited

U.S. PATENT DOCUMENTS

| | | | | |
|---|---|---|---|---|
| 2011/0098409 | A1* | 4/2011 | Burch | C08K 7/06 524/600 |
| 2012/0235071 | A1* | 9/2012 | Moralez | C08G 73/1014 524/404 |
| 2015/0064043 | A1* | 3/2015 | Kemp | F01C 21/108 418/261 |

* cited by examiner

SELF-ROTATION GRAPHENE HEAT-DISSIPATION DEVICE FOR DIRECT-DRIVE ELECTRO-HYDROSTATIC ACTUATOR

CROSS REFERENCE TO RELATED APPLICATIONS

This patent application claims the benefit and priority of Chinese Patent Application No. 202110599854.6, entitled "SELF-ROTATION GRAPHENE HEAT-DISSIPATION DEVICE FOR DIRECT-DRIVE ELECTRO-HYDROSTATIC ACTUATOR" filed with the Chinese Patent Office on May 31, 2021, the disclosure of which is hereby incorporated by reference herein in its entirety for all purposes.

TECHNICAL FIELD

The present disclosure relates to a self-rotation graphene heat-dissipation device for a direct-drive electro-hydrostatic actuator, and belongs to the technical field of hydraulic devices.

BACKGROUND ART

A direct-drive electro-hydrostatic actuator (EHA) is a power unit which is highly integrated with hydraulic components such as a motor, a pump, a hydraulic valve group and a hydraulic cylinder. The direct-drive EHA has advantages of being light in weight, small in size, large in power density and the like, and is widely applied to various fields such as aviation, agriculture, and medical treatment.

The direct-drive electro-hydrostatic actuator is a typical closed-type hydraulic system. The highly integrated characteristic of the direct-drive EHA causes limited heat-dissipation space of the direct-drive EHA, and reduces the heat exchange capacity of the direct-drive EHA. Thus, the oil temperature of the direct-drive EHA can also rapidly rise, and overhigh oil temperature can bring great harm to normal operation of the direct-drive EHA system. According to statistics, when the temperature is increased by 15° C., the stable service life of the medium is reduced by 90%. Viscosity and lubricity of hydraulic oil can be reduced by temperature rise, and the sealing performance of the direct-drive EHA system is seriously influenced. In addition, the temperature rise can cause parts to expand and deform, and accelerate aging of the parts. Therefore, the heat-dissipation performance is one of key issues capable of restricting rapid development and application of the direct-drive electro-hydrostatic actuator.

There are two common methods currently used to solve the heat-dissipation problem of the direct-drive electro-hydrostatic actuator.

According to one method, the heat productivity of the direct-drive electro-hydrostatic actuator is reduced through reasonable power matching of the EHA system. Due to the influence of operating condition requirements and power loss, the effect of the power matching method for solving the heat-dissipation problem is limited. The heat-dissipation through an external cooler is another common method. The existing cooler is heavy in mass, large in size, high in energy consumption, and is in serious contradiction with the characteristics of high integration, miniaturization, and high efficiency of the direct-drive electro-hydrostatic actuator. Therefore, a heat-dissipation device which is miniaturized and has lower energy consumption and higher heat-dissipation efficiency is urgently needed to meet the heat-dissipation requirement of a highly integrated direct-drive electro-hydrostatic actuator.

SUMMARY

In order to solve the problems in the background art, the present disclosure provides a self-rotation graphene heat-dissipation device for a direct-drive electro-hydrostatic actuator.

In order to achieve the above purpose, the present disclosure provides the following technical scheme: a self-rotation graphene heat-dissipation device for a direct-drive electro-hydrostatic actuator includes a shell, a shaft, a self-rotation mechanism, an outer end cover, an inner end cover and graphene heat-dissipation layers. An inner wall and an outer wall of the shell are eccentrically arranged relative to each other, and the shell sleeves on an outer side of the self-rotation mechanism. The self-rotation mechanism is coaxially arranged on an outer side of the shaft, the shaft and the inner wall of the shell are coaxially arranged, one end of the shaft is connected with the outer end cover, and another end of the shaft is connected with the inner end cover. The self-rotation mechanism includes a rotor and multiple blades, the rotor coaxially sleeves on the outer side of the shaft, two end faces of the rotor are fixedly connected with the outer end cover and the inner end cover respectively, each of the multiple blades is slidably connected with an outer wall of the rotor, and an outer wall of each of the blades is closely attached to the inner wall of the shell. The graphene heat-dissipation layers are coated on the outer wall of the shell, the outer wall of each of the blades, the outer wall of the rotor, an outer wall of the inner end cover and an outer wall of the outer end cover respectively.

Compared with the prior art, the embodiments have the following beneficial effects.

Firstly, graphene is used, and the graphene can have the heat conductivity that reaches 5300 W/mk at most as a new material, which is ten times higher than that of metal copper. So, the heat conduction performance is excellent.

Secondly, rich hydraulic energy in the direct-drive electro-hydrostatic actuator is utilized, the hydraulic energy of the direct-drive electro-hydrostatic actuator drives the heat-dissipation device to rotate, and the surface heat dissipation coefficient of the direct-drive EHA is further improved by using graphene. So, the high heat conduction characteristic of the graphene can be fully exerted, and an external input source is abandoned. In this way, energy conservation of the direct-drive EHA system and miniaturization of the heat-dissipation device can be facilitated, thereby satisfying the requirements of high integration, low energy consumption and high heat-dissipation rate of the direct-drive electro-hydrostatic actuator.

Thirdly, the self-rotation graphene heat-dissipation device can be integrated on the direct-drive electro-hydrostatic actuator to achieve high-efficiency heat-dissipation, which can solve the problems that the direct-drive electro-hydrostatic actuator is poor in heat-dissipation performance, and the heavy mass and the large size of the existing cooling device cannot meet the requirements of high integration, miniaturization and high heat-dissipation efficiency of the direct-drive electro-hydrostatic actuator.

Fourthly, the graphene with high heat conduction performance is applied to the heat dissipation of the direct-drive electro-hydrostatic actuator. So, the self-rotation graphene heat-dissipation device is provided, and the inner surfaces and the outer surfaces of all parts thereof in contact with hydraulic oil are coated with the graphene which can conduct heat from the hydraulic oil in the direct-drive electro-hydrostatic actuator efficiently.

Fifthly, heat-dissipation pipes are additionally arranged, so that the surface area coated with the graphene can be enlarged, and the heat transfer area of the device can be increased. Further, the heat-dissipation efficiency of unit geometric space can be improved, and integration of the device can be facilitated.

Sixthly, hydraulic energy in the direct-drive electro-hydrostatic actuator is fully utilized to drive the self-rotation mechanism, so as to drive the heat-dissipation components to rotate, thereby increasing air flow near the heat-dissipation device, improving the surface heat-dissipation coefficient, and efficiently dissipating heat conducted by graphene.

DETAILED DESCRIPTION OF THE EMBODIMENTS

Figure 1:
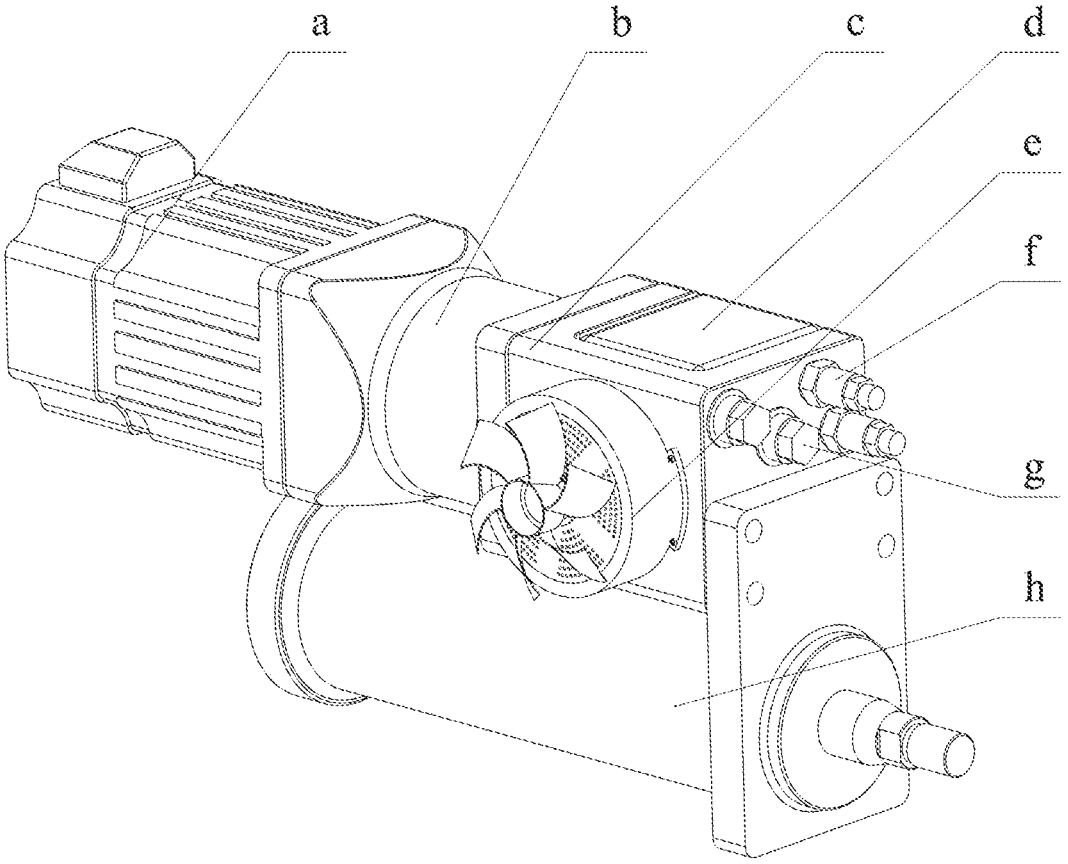
FIG. 1 is a three-dimensional schematic diagram of a direct-drive electro-hydrostatic actuator.
Figure 2:
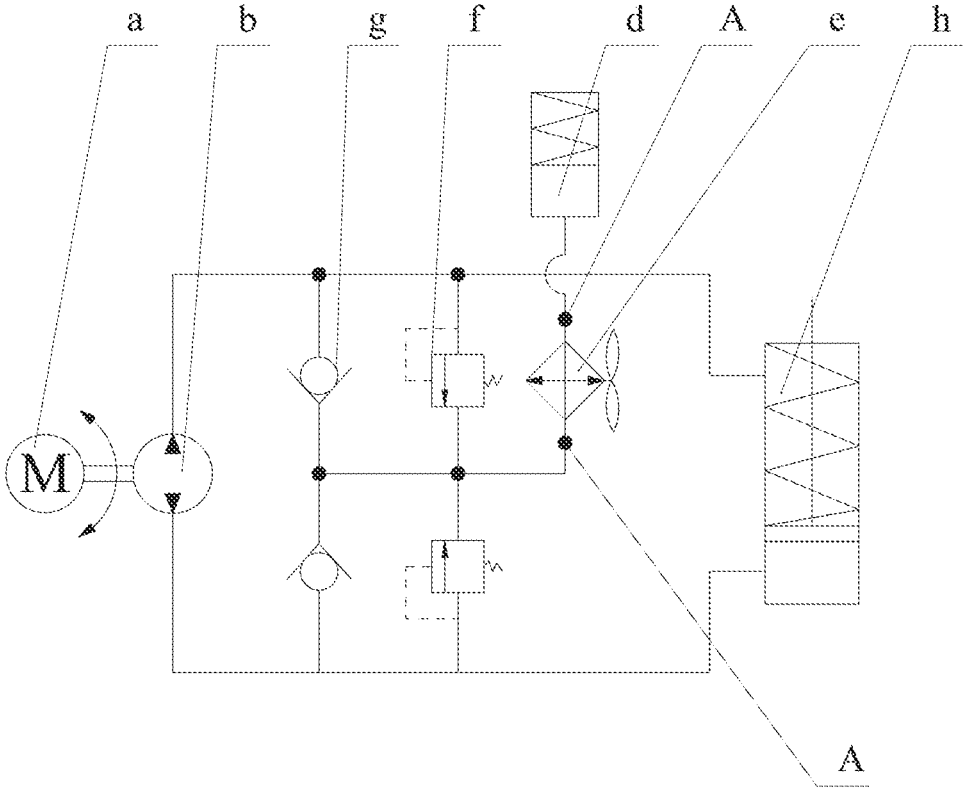
FIG. 2 is a schematic diagram of the direct-drive electro-hydrostatic actuator.
Figure 3:
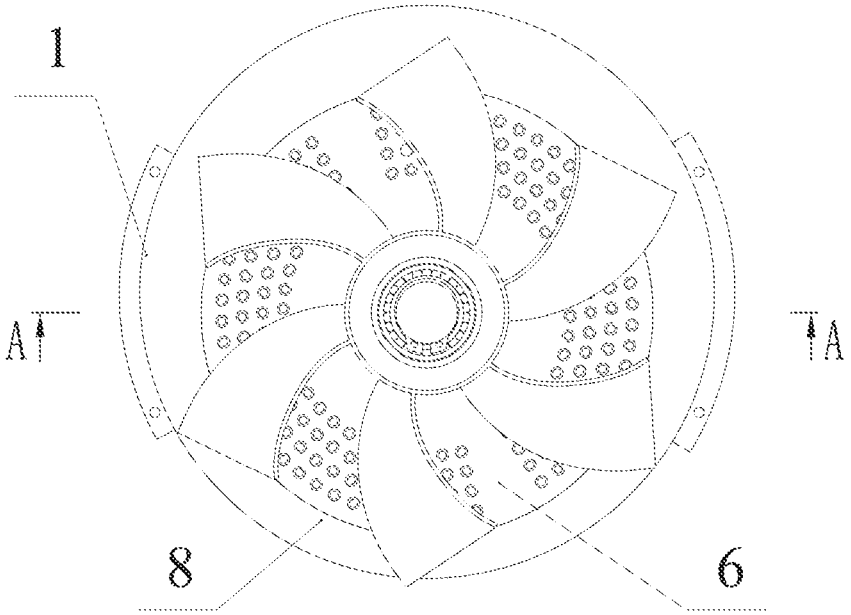
FIG. 3 is a front view of a self-rotation graphene heat-dissipation device according to the present disclosure.
Figure 4:
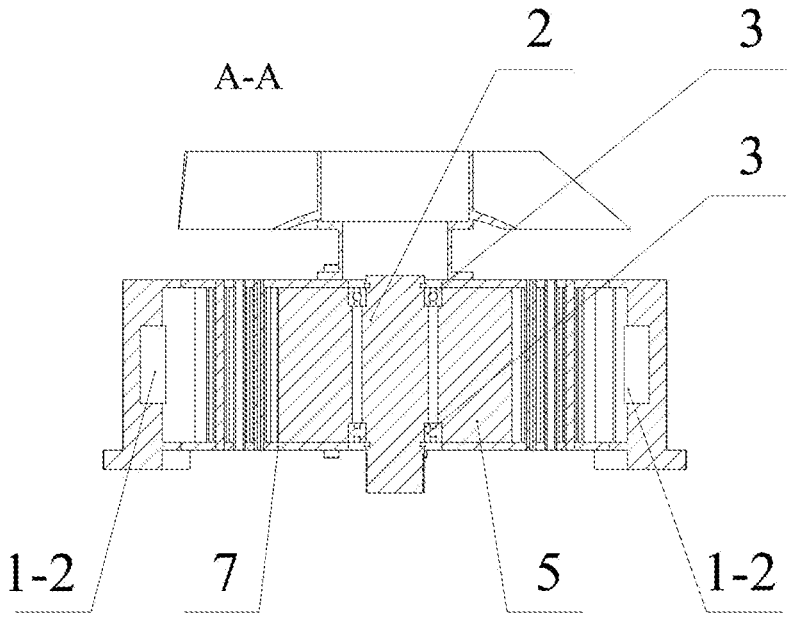
FIG. 4 is a section view along line A-A of FIG. 3.
Figure 5:
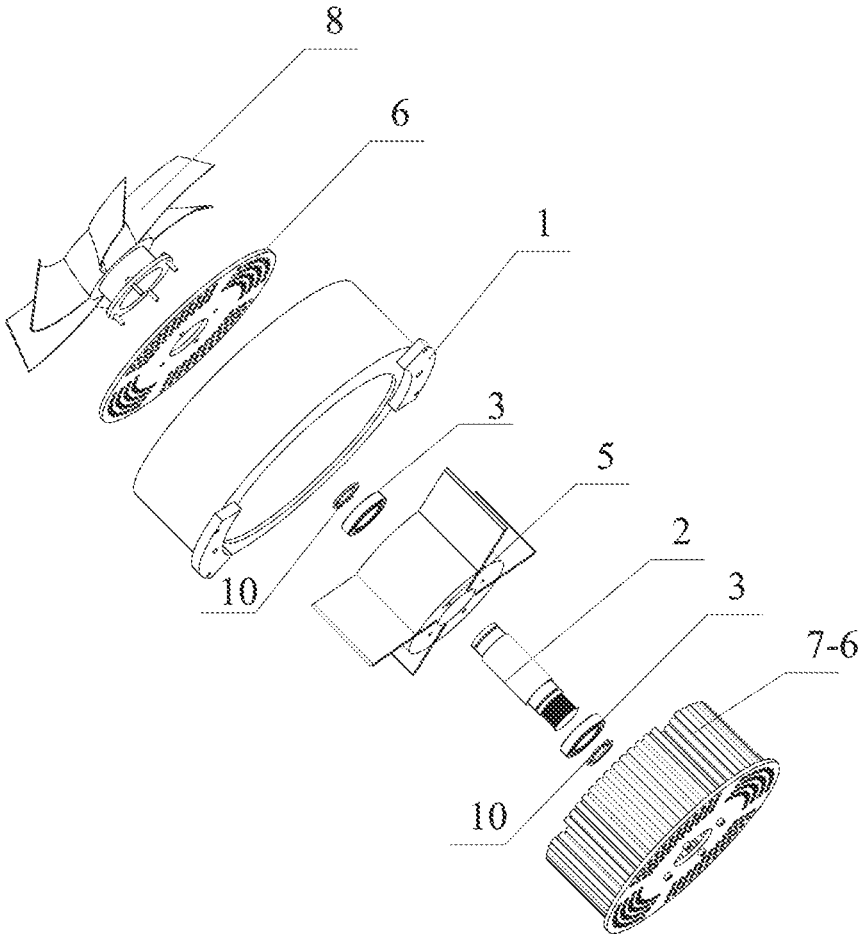
FIG. 5 is an exploded diagram of the self-rotation graphene heat-dissipation device in FIG. 3.
Figure 6:
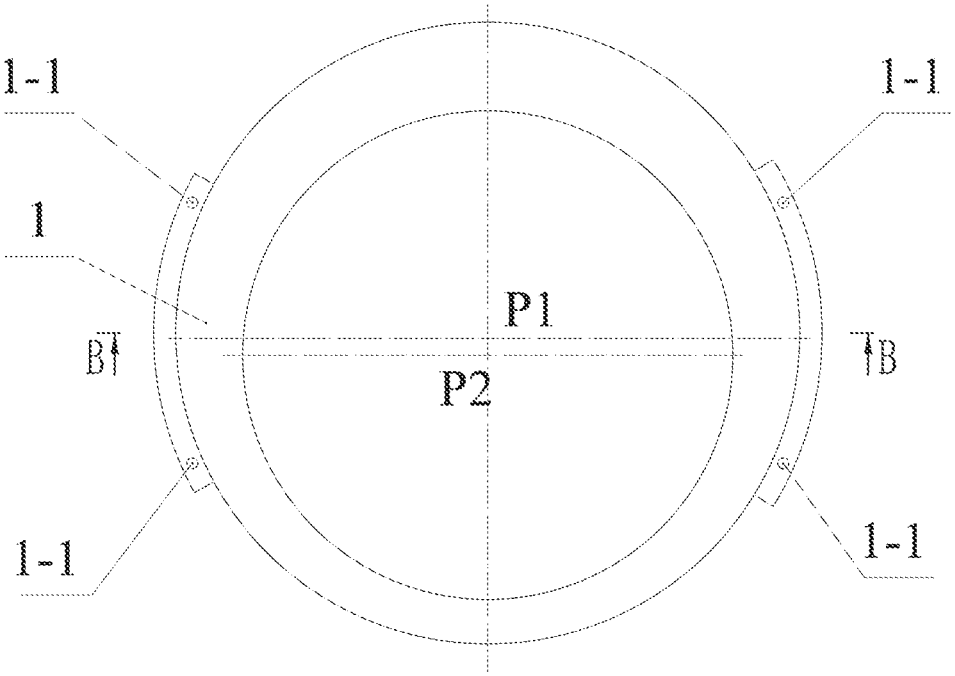
FIG. 6 is a front view of a shell.
Figure 7:
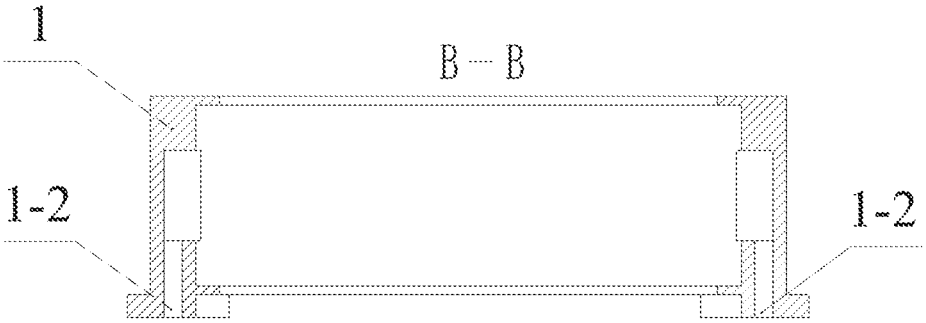
FIG. 7 is a section view along line B-B of FIG. 6.
Figure 8:
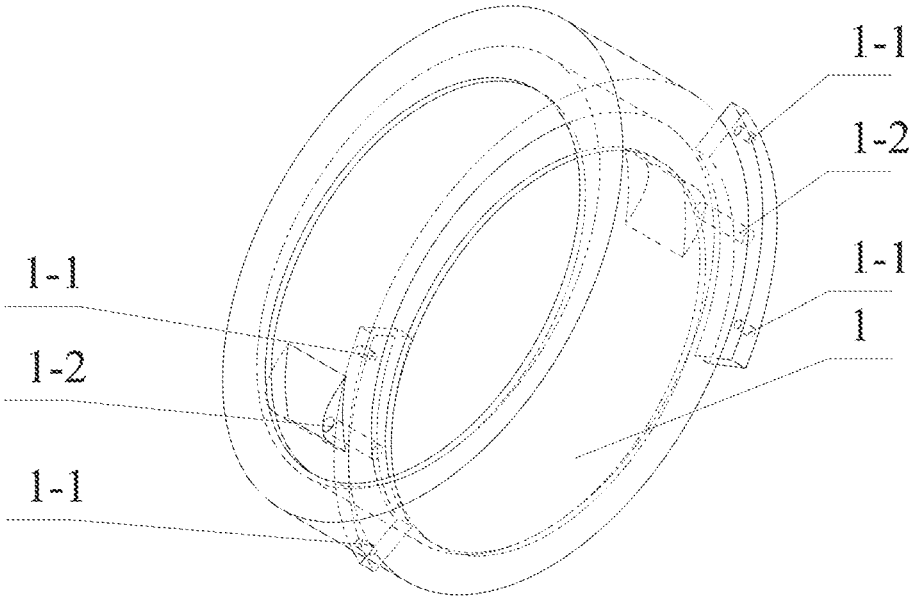
FIG. 8 is a three-dimensional schematic diagram of FIG. 6.
Figure 9:
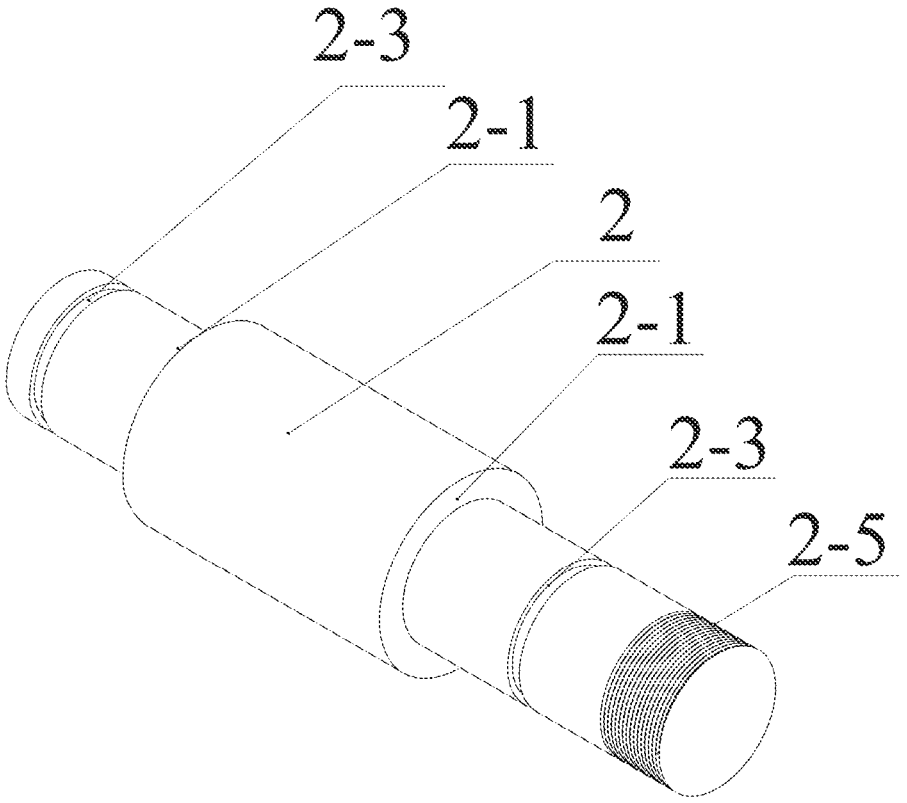
FIG. 9 is a three-dimensional schematic diagram of a shaft.
Figure 10:
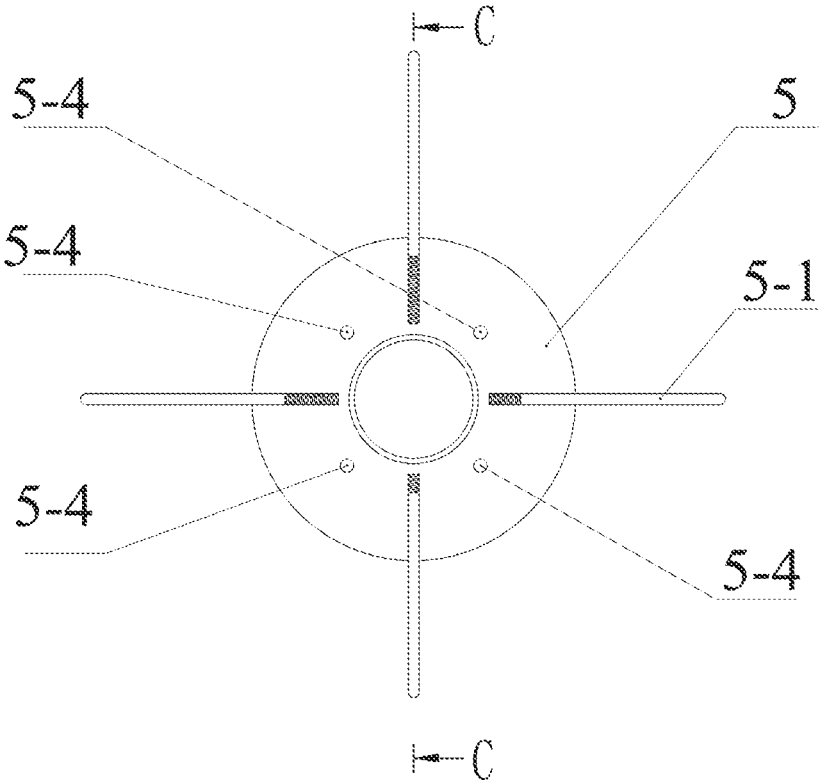
FIG. 10 is a front view of a self-rotation mechanism.
Figure 11:
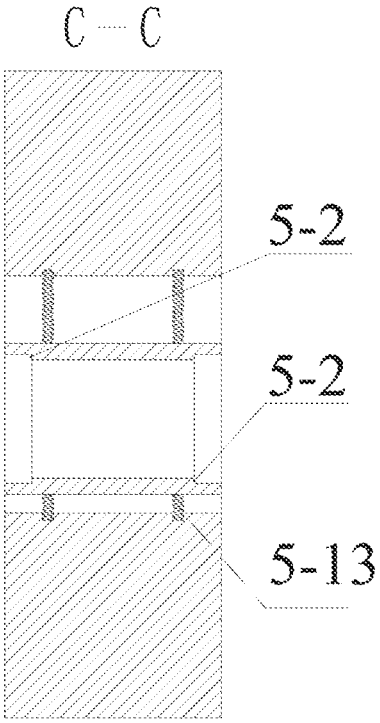
FIG. 11 is a section view along line C-C of FIG. 10.
Figure 12:
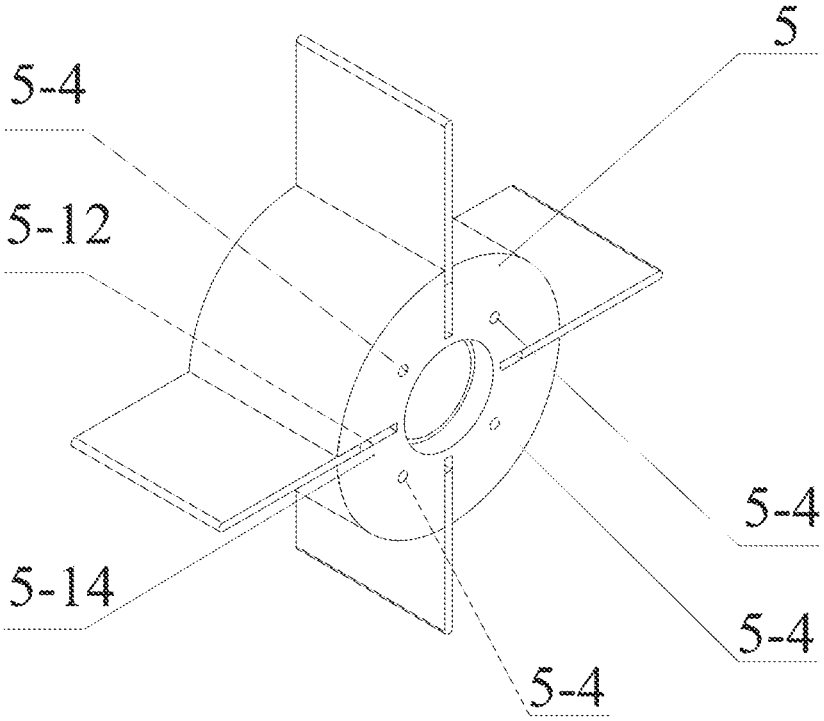
FIG. 12 is a three-dimensional schematic diagram of FIG. 10.
Figure 13:
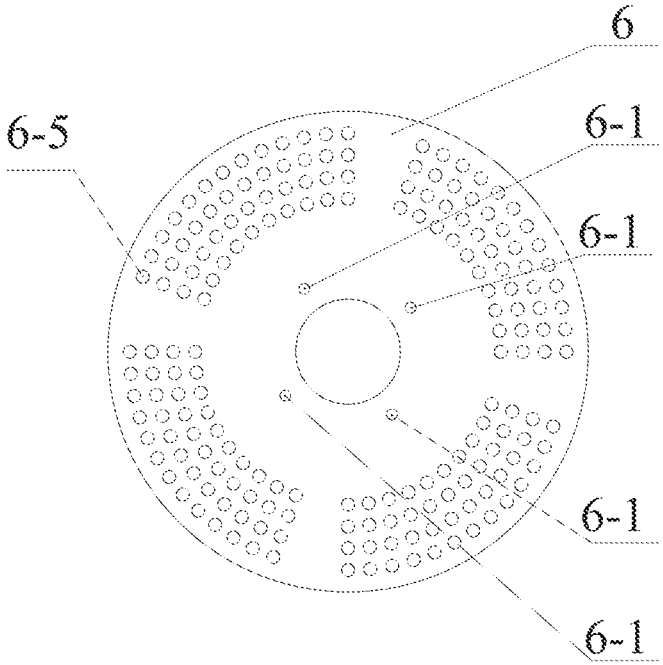
FIG. 13 is a front view of an outer end cover.
Figure 14:
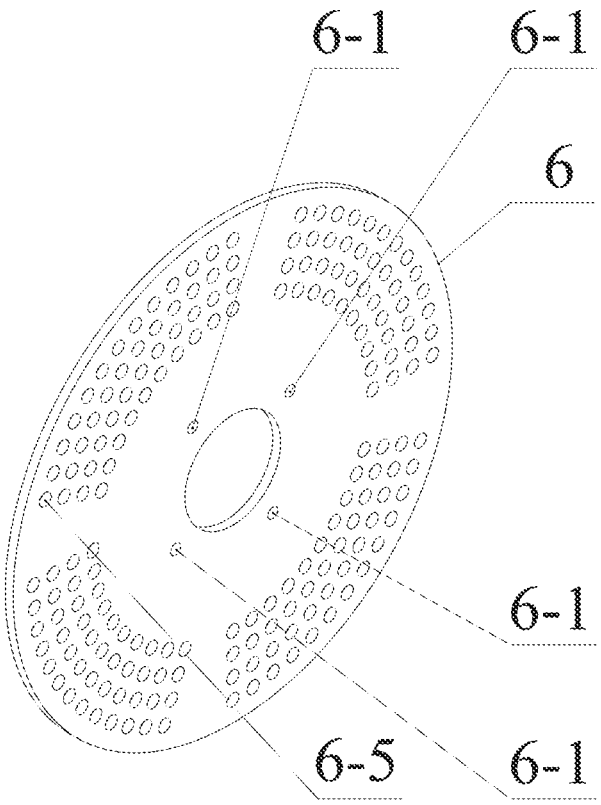
FIG. 14 is a three-dimensional schematic diagram of FIG. 13.
Figure 15:
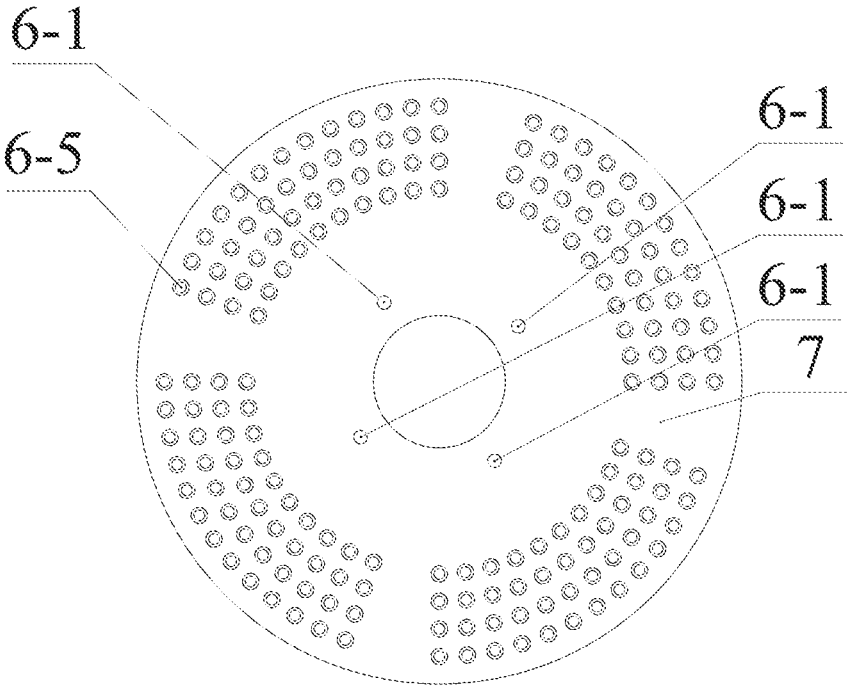
FIG. 15 is a front view of an inner end cover.
Figure 16:
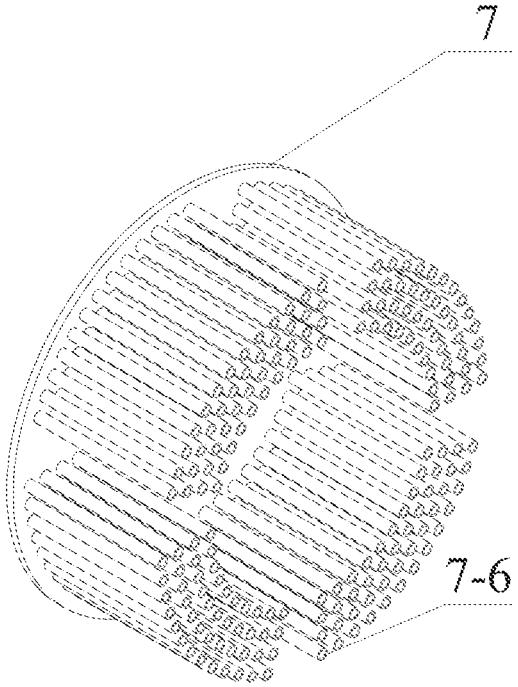
FIG. 16 is a three-dimensional schematic diagram of FIG. 15.
Figure 17:
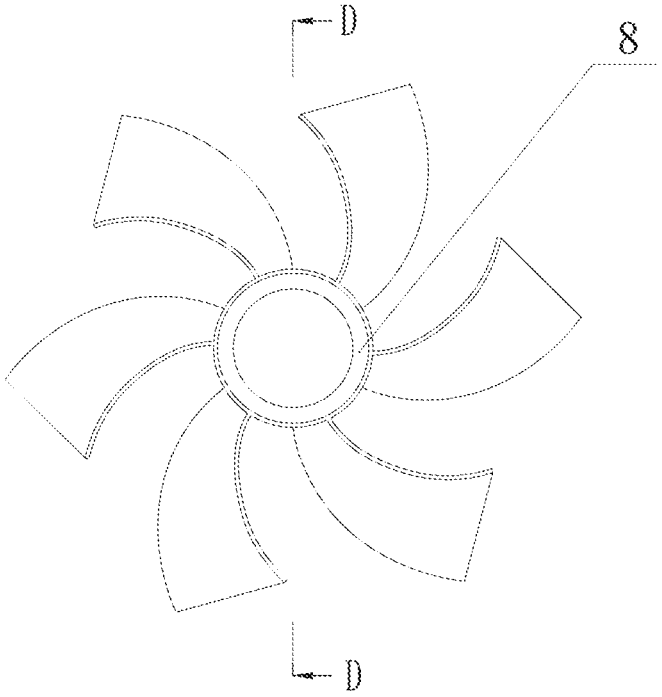
FIG. 17 is a front view of an outer fan.
Figure 18:
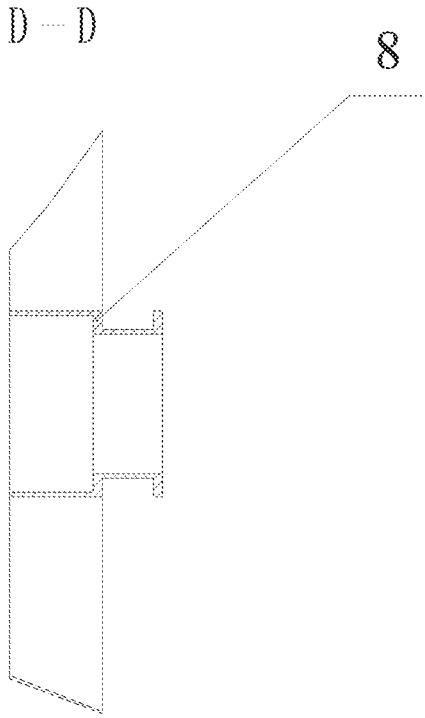
FIG. 18 is a section view along line D-D of FIG. 17.
Figure 19:
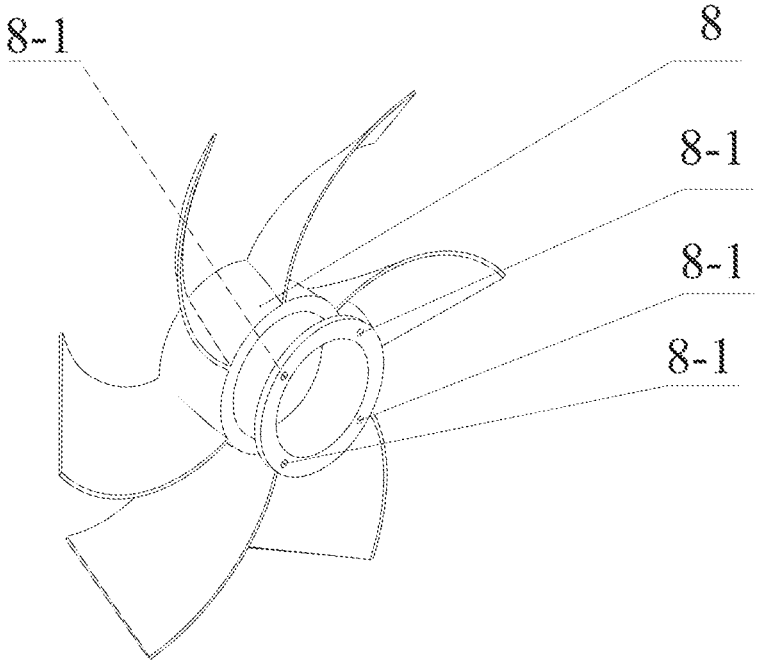
FIG. 19 is a three-dimensional schematic diagram of FIG. 17.
Figure 20:
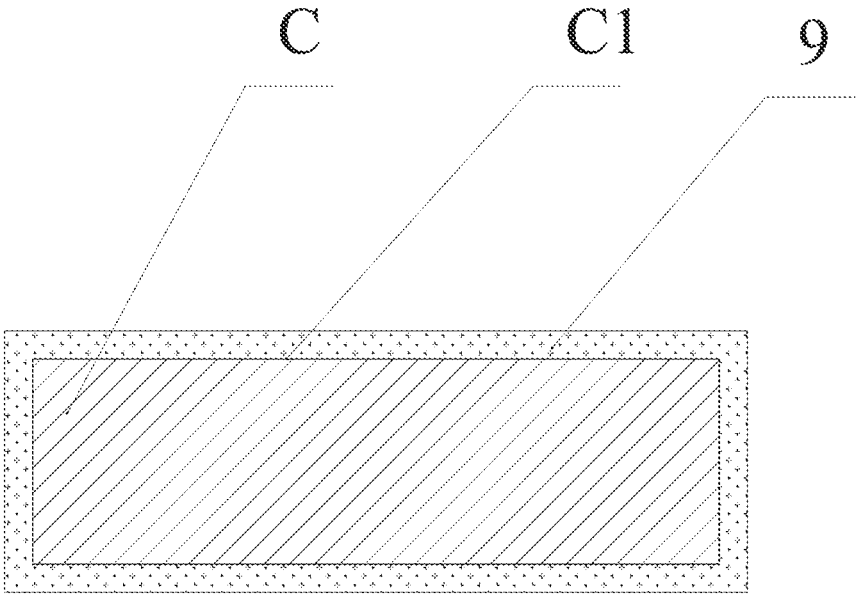
FIG. 20 is a schematic diagram of a graphene heat-dissipation layer.

Technical solutions in the embodiments of the present disclosure will be clearly and completely described herein below with reference to the drawings in the embodiments of the present disclosure. Apparently, the described embodiments are merely a part rather than all of the embodiments of the present disclosure. Based on the embodiments of the present disclosure, all other embodiments obtained by those skilled in the art without creative efforts shall fall within the protection scope of the present disclosure.

A self-rotation graphene heat-dissipation device for a direct-drive electro-hydrostatic actuator includes a shell 1, a shaft 2, a self-rotation mechanism 5, an outer end cover 6, an inner end cover 7 and graphene heat-dissipation layers 9. The shell 1 is arranged on a valve block c of the electro-hydrostatic actuator (EHA) and then sleeves on the outer side of the self-rotation mechanism 5. One end of the shell 1 is in sealed connection with the outer end cover 6 via a seal ring, and the other end of the shell 1 is in sealed connection with the inner end cover 7 via another seal ring. The self-rotation mechanism 5 is coaxially arranged on the outer side of the shaft 2. One end of the shaft 2 is connected with the outer end cover 6, and the other end of the shaft 2 is connected with the valve block c of the EHA by penetrating through the inner end cover 7. The self-rotation mechanism 5 includes a rotor 5-14 and multiple blades 5-1. The rotor 5-14 coaxially sleeves on the outer side of the shaft 2. Four second bolt holes 5-4 are formed in each one of the two end faces of the rotor 5-14. The rotor 5-14 are correspondingly and fixedly connected with the outer end cover 6 and the inner end cover 7 by inserting one of the bolts into a corresponding one of the second bolt holes 5-4 respectively. The outer wall of the rotor 5-14 is slidably connected with the uniformly distributed blades 5-1 along the radial direction of the rotor 5-14, and the outer wall of each of the blades 5-1 is closely attached to the inner wall of the shell 1. The graphene heat-dissipation layers 9 are coated on the whole surface C1 of the component C, and the component C includes the outer wall of the shell 1, the blades 5-1, the rotor 5-14, the inner end cover 6 and the outer end cover 7. And the graphene heat-dissipation layers 9 may be single-layer graphene, multi-layer graphene, graphene oxide, graphene composite heat-dissipation coating, graphene heat-dissipation films or other graphene heat-dissipation materials.

The shell 1, the self-rotation mechanism 5, the outer end cover 6 and the inner end cover 7 are made of aluminum alloy, titanium alloy, magnesium alloy or other metal materials.

The shaft 2 is made of the No. 45 steel (Chinese standard), the carbon steel, the alloy steel, the nodular cast iron or other metal materials.

The shell 1 is of a cylindrical structure, and the inner wall and the outer wall of the shell 1 are eccentrically arranged relative to each other. Two mounting ears are symmetrically arranged on the outer wall of the shell 1 along the radial direction of the shell 1. Two first bolt holes 1-1 are formed in each of the two mounting ears. The shell 1 is fixed to the valve block c of the EHA by inserting one of the bolts into a corresponding one of the first bolt holes 1-1. Two oil ports 1-2 are symmetrically formed in a shell body 1 along the radial direction of the shell 1. One end of each of the two oil ports 1-2 penetrates through the inner wall of the shell 1, and the other end of the oil port 1-2 penetrates through the mounting end face of the shell 1 and is in sealed and close attachment with an oil port A of an oil return path of an accumulator of the EHA.

Multiple sliding grooves 5-12 formed along the radial direction of the rotor 5-14 are evenly distributed in the outer wall of the rotor 5-14 along the circumferential direction of the rotor 5-14. And, one end of each of the multiple blades 5-1 is inserted into a corresponding one of the multiple sliding grooves 5-12 and elastically connected with the bottom face of the corresponding one of the multiple sliding grooves 5-12 via a spring 5-13. The blades 5-1 are tightly attached to the surface of the inner wall of the shell 1 under the action of pressing force of the springs 5-13, and are rotated and slid along with the rotation of the rotor 5-14. The blades 5-1 can slide up and down in the respective sliding grooves 5-12 along the radial direction of the rotor 5-14.

The other end of the shaft 2 is provided with an external thread 2-5 by which the shaft 2 is fixed to the valve block c of the EHA. Two shaft shoulders 2-1 and two annular grooves 2-3 are arranged on the outer wall of the shaft 2. The two shaft shoulders 2-1 are located between the two annular grooves 2-3. A bearing 3 is arranged at each of the two shaft shoulders 2-1. A check ring 10 is arranged in each of the two annular groove 2-3. The shaft 2 is connected with the rotor 5-14 via the bearings 3, and the check ring 10 is configured for fixing the bearing 3. An inner-hole boss 5-2 is arranged on the inner wall of the rotor 5-14 in a circumstantial direction of the rotor, and edges of the inner-hole boss which are in an axial direction of the rotor are adjacent to the two end faces of the rotor 5-14. And, the edges of the inner-hole boss are arranged to abut against the respective bearings 3 in the axial direction, and the bearings 3 are in interference fit with the inner wall of the rotor 5-14, so that the rotor 5-14 can rotate around the shaft 2.

The outer end cover 6 and the inner end cover 7 are both sleeved on the outer side of the shaft 2, and are each uniformly provided with multiple sets of heat-dissipation holes 6-5 penetrating through the respective thickness directions thereof along the respective circumferential directions thereof. Each set of heat-dissipation holes 6-5 includes multiple heat-dissipation holes 6-5 arranged in array. Four third bolt holes 6-1 are provided on each of the outer cover and the inner end cover, and the outer cover and the inner end cover are fixedly connected with the rotor 5-14 by inserting one of the bolts into a corresponding one of the third bolt holes 6-1 respectively.

A heat-dissipation pipe 7-6 is arranged between one of the heat-dissipation holes 6-5 of the outer end cover 6 and a corresponding one of the heat-dissipation holes 6-5 of the inner end cover 7 in an interference fit mode, and sealed via a seal ring at a engagement position therebetween. The section shapes of both the heat-dissipation pipe 7-6 and the heat-dissipation hole 6-5 can be round, square, rhombus, triangle, ellipse or other geometric shapes capable of increasing the heat-dissipation area. A graphene heat-dissipation layer 9 is arranged on the outer surface of each of the heat-dissipation pipes 7-6. The whole covering surface area of the graphene heat-dissipation layers 9 is increased by providing the heat-dissipation pipes 7-6. The outer wall faces of the heat-dissipation pipes 7-6 are in contact with oil, and the inner wall face and the two end faces of each of the heat-dissipation pipes 7-6 are in contact with air, so that the heat conduction path of the high-temperature oil and the air can be shortened.

An outer fan 8 is arranged at the outer side of the outer end cover 6. The outer fan 8 is connected with the outer end cover 6 by inserting one of the bolts into a corresponding one of the fourth bolt holes 8-1. A graphene heat-dissipation layer 9 is arranged on the outer surface of the outer fan 8. Graphene heat-dissipation layers 9 can be coated on the surfaces of other parts such as a hydraulic cylinder h of the EHA, an accumulator d of the EHA or an oil pump b of the EHA.

The surrounding air can fully flow in the present disclosure, especially under the action of the outer fan 8. The surface heat-dissipation coefficient can be improved, and the heat of high-temperature oil in the EHA can be quickly dissipated. The outer fan 8 is made of plastics, high-strength carbon fiber resin matrix composite materials or other composite light materials.

The direct-drive electro-hydrostatic actuator includes a servo motor a, a hydraulic pump b, a valve block c, an accumulator d, an overflow valve f, a one-way valve g and a hydraulic cylinder h. The self-rotation graphene heat-dissipation device in the present disclosure can also be applied to direct-drive electro-hydrostatic actuators utilizing other principles.

The valve block c can be mounted on an oil return path on the accumulator d for use, and can also be mounted on an oil inlet and an outlet path of the hydraulic cylinder h for use.

In the embodiment, the self-rotation graphene heat-dissipation device for a direct-drive electro-hydrostatic actuator is provided. When the accumulator d supplements oil to the EHA system, hydraulic oil flows out of one oil port A of the oil return path of the accumulator d and enters a closed chamber formed by the blades 5-1, the outer wall of the rotor 5-14, the inner wall of the shell 1, the outer end cover 6, the inner end cover 7 and the heat-dissipation pipes 7-6 through the oil ports of the shell 1-2. Due to the fact that the self-rotation mechanism 5 and the shell 1 are eccentrically arranged relative to each other, the contact area between one of the two blades and oil in the closed chamber are different from that between another one of the two blades and the oil in the closed chamber. Under the action of oil with pressure, the two blades are stressed unevenly so that the rotor can generate torque rotation to rotate, and the outer fan 8, the blades 5-1, the outer end cover 7, the inner end cover 6 and the heat-dissipation pipes 7-6 coaxially rotate along with the rotation of the rotor 5-14. The hydraulic oil is pressed into the other oil port of the shell 1-2 during the rotating process of the rotor, and oil is supplemented to the EHA system through the other oil port A of the oil return way of the accumulator. Conversely, when oil of the EHA system returns back to the accumulator, the hydraulic oil flows out from the oil port A corresponding to the oil return path on the accumulator and enters the closed chamber through the corresponding oil port of the shell 1-2. Under the action of the oil with pressure, the two blades in the closed chamber are unbalanced in stress, so that the rotor can generate torque to rotate in an opposite direction. And, the hydraulic oil is pressed into the other oil port of the shell 1-2 in the rotating process of the rotor and flows back to the accumulator through another oil port A of the oil return path on the accumulator.

For those skilled in the art, obviously the present disclosure is not limited to the details of the exemplary embodiment, and the present disclosure can be achieved in other specific forms without departing from the spirit or essential characteristics of the present disclosure. Therefore, for every point, the embodiments should be regarded as exemplary embodiments and are unrestrictive, the scope of the present disclosure is restricted by the claims appended hereto, and therefore, all changes, including the meanings and scopes of equivalent elements, of the claims are aimed to be included in the present disclosure. Any reference of attached figures in the claims should not be regarded as limitation to the involved claims.

Further, it should be understood that although the present specification is described with reference to embodiments, not each embodiment contains only one independent technical scheme. The specification is so described just for clarity. Those skilled in the art should regard the specification as a whole, and technical schemes of various embodiments can be combined appropriately to form other implementations which can be understood by those skilled in the art.

What is claimed is:

1. A self-rotation graphene heat-dissipation device for a direct-drive electro-hydrostatic actuator, comprising a shell, a shaft, a self-rotation mechanism, an outer end cover, an inner end cover, and graphene heat-dissipation layers, wherein an inner wall and an outer wall of the shell are eccentrically arranged relative to each other, and the shell sleeves on an outer side of the self-rotation mechanism; the self-rotation mechanism is coaxially arranged on an outer side of the shaft, the shaft and the inner wall of the shell are coaxially arranged, one end of the shaft penetrates through the outer end cover, and another end of the shaft is connected with a valve block of the direct-drive electro-hydrostatic actuator by penetrating through the inner end cover; the self-rotation mechanism comprises a rotor and a plurality of blades, the rotor coaxially sleeves on the outer side of the shaft, two end faces of the rotor are fixedly connected with the outer end cover and the inner end cover respectively, each of the plurality of blades is slidably connected within an outer wall of the rotor, and an outer wall of each of the plurality of blades contact the inner wall of the shell; and the graphene heat-dissipation layers are coated on the outer wall of the shell, the outer wall of each of the plurality of blades, the outer wall of the rotor, an outer wall of the inner end cover and an outer wall of the outer end cover, respectively, wherein two mounting ears are symmetrically arranged on a surface of the outer wall of the shell, which is away from the outer end cover, first bolt holes are formed in each of the two mounting ears, two oil ports are symmetrically formed in the shell, one end of each oil port of the two oil ports penetrates through the inner wall of the shell, and another end of the oil port penetrates through a mounting end face of the shell;

wherein a plurality of sliding grooves are formed in the outer wall of the rotor, and one end of each of plurality of the blades is inserted into a corresponding one of the plurality of sliding grooves and elastically connected with a bottom face of the corresponding one of the plurality of sliding grooves via a spring; and wherein an external thread is formed on the other end of the shaft, two shaft shoulders and two annular grooves are arranged on the outer side of the shaft, the two shaft shoulders are located between the two annular grooves, the two shaft shoulders are provided with respective bearings, the two annular grooves are provided with respective check rings, the shaft is connected with the rotor via the bearings, and each of the check rings is configured for fixing a corresponding one of the bearings.

2. The self-rotation graphene heat-dissipation device for the direct-drive electro-hydrostatic actuator according to claim 1, wherein the outer end cover and the inner end cover both sleeve on the outer side of the shaft and are each provided with a plurality of sets of heat-dissipation holes, and each of the plurality of sets of heat-dissipation holes comprises a plurality of heat-dissipation holes.

3. The self-rotation graphene heat-dissipation device for the direct-drive electro-hydrostatic actuator according to claim 2, wherein a heat-dissipation pipe is arranged between each of the heat-dissipation holes in the outer end cover and a corresponding one of the heat-dissipation holes in the inner end cover.

4. The self-rotation graphene heat-dissipation device for a direct-drive electro-hydrostatic actuator according to claim 3, wherein an outer fan is arranged at an outer side of the outer end cover.

5. The self-rotation graphene heat-dissipation device for the direct-drive electro-hydrostatic actuator according to claim 2, wherein an outer fan is arranged at an outer side of the outer end cover.

6. The self-rotation graphene heat-dissipation device for a direct-drive electro-hydrostatic actuator according to claim 1, wherein an outer fan is arranged at an outer side of the outer end cover.

7. The self-rotation graphene heat-dissipation device for the direct-drive electro-hydrostatic actuator according to claim 1, wherein an outer fan is arranged at an outer side of the outer end cover.

8. The self-rotation graphene heat-dissipation device for the direct-drive electro-hydrostatic actuator according to claim 1, wherein an outer fan is arranged at an outer side of the outer end cover.

* * * * *